United States Patent [19]

Galvin

[11] Patent Number: 4,971,335

[45] Date of Patent: Nov. 20, 1990

[54] TOSS BALL GAME DEVICE

[76] Inventor: Patrick J. Galvin, 39 Lynwood Dr., Wolcott, Conn. 06716

[21] Appl. No.: 482,809

[22] Filed: Feb. 21, 1990

[51] Int. Cl.[5] ..... A63B 67/00

[52] U.S. Cl. ..... 273/411; 273/381; 273/386

[58] Field of Search ..... 273/381, 382, 411, 413, 273/386

[56] References Cited

U.S. PATENT DOCUMENTS

| | | | |
|---|---|---|---|
| 437,267 | 9/1890 | Walker | 273/386 |
| 773,167 | 10/1904 | Spink | 273/411 X |
| 854,640 | 5/1907 | Fuller | 273/381 |
| 1,509,490 | 9/1924 | Sawyer | 273/411 |
| 4,346,902 | 8/1982 | Warehime | 273/413 X |
| 4,523,762 | 6/1985 | Garner, Sr. | 273/411 |

*Primary Examiner*—William H. Grieb

*Attorney, Agent, or Firm*—Lawrence Hager

[57] ABSTRACT

A game device and method of playing same. The game/toy device generally comprises a cord which is fastened to two spaced apart support posts that are vertically mounted from the ground. An alarm or bell device(s) is connected or attached to said cord. The user/player may score a point by tossing a ball or other object at the cord and hitting it. The alarm/bell device signals each point made. A selected number of hits wins the game.

2 Claims, 2 Drawing Sheets

TOSS BALL GAME DEVICE

FIELD OF THE INVENTION

The present invention relates to a game/toy device and method of playing same and, more particularly, to a compact, relatively inexpensive, safe and easy to play game or toy for use on a lawn or in relatively small areas.

BACKGROUND OF THE INVENTION

The lawn type games exemplified in the prior art typically are complex, relatively expensive, require difficult to understand instructions and rules and many are dangerous for young children. Safety is of high importance and the present invention is relatively safe and uncomplicated for children to play.

PRIOR ART STATEMENT

A known lawn game device is shown in U.S. Pat. No. 4,523,762 issued June 18, 1985 to Ronald S. Garner, Sr.

Other prior art patents of interest include U.S. Pat. Nos. 437,267 issued Sept. 30, 1890 to L.C. Walker; 773,167 issued Oct. 25, 1904 to F. E. Spink.

These patents are mentioned as being representative of the prior art and other pertinent references may exist. None of the above cited patents are deemed to affect the patentability of the present claimed invention.

The present invention involves a novel combination of features combined in such a way as to afford a very efficient, relatively inexpensive game/toy which has significant advantages over the prior art that will become more apparent as the description proceeds.

For example, in contrast to the prior art, the present invention provides a simple and easy to use/play one-handed or two handed game that can be played by one or more participants on one or both sides of the target cord; is a relatively safe competitive game for all ages; can be played in confined or open areas such as yards, on beaches, gymnasiums, tennis - badminton - vollyball or basketball courts, etc.; and/or a single backboard type court or wall can be utilized to rebound the ball for practice or play.

SUMMARY OF THE INVENTION

Generally speaking, in accordance with the invention, a toss ball game is provided which utilizes a pair of spaced apart vertically mounted support poles, a line or cord stretched between said poles, and a ball or other small object which can be tossed at the cord.

The game is played by a single player by locating the game device, i.e., the support poles and stretched cord, in juxtaposition to a back stop or wall. The player is then positioned behind a line or marking placed on the ground a predetermined distance from the stretched cord. The predetermined distance may be selected to accommodate the age, ability, etc. of the player. The player thence proceeds to throw the ball at the stretched cord. The object of the game is to hit the stretched cord and, thereby, score a point. Each player (or one player) is given one or more turns to throw the ball at the stretched cord. The player who scores the most hits is the winner.

With two or more players, the target line and support poles are positioned to enable disposition of players on opposite sides of target line. Each player is located on or about a ground line equidistant from the target line.

The degree of difficulty and/or the point scoring increases as the distance from the target line increases.

A handicap system may be established by varying the distances of the competitors from the target line. In this manner, handicap adjustments, for example, child versus adult, or old aged versus young aged or male versus female competitors, can be implemented to increase interest competitive play.

A coin flip is sufficient to start the game. Player A tosses the ball generally underhand toward Player B, with the goal of hitting the target line and, thereby scoring one point. Player B then gets the opportunity to return toss the ball toward Player A, again with the goal of hitting the target line and, thereby, scoring one point for Player B side.

Scoring may generally be maintained by each player until a predetermined winning point, for example, a score of eleven or twenty-one is achieved.

Single or multiple games or sets can be played and, a game, set and match scoring procedure utilized similar to the game of tennis. However, the present invention provides a relatively less expensive, less difficult to learn and play game than tennis, while enabling differently skilled players to complete against each other with a handicapping system comprising of multiple distant foul lines.

OBJECTIVES OF THE INVENTION

Accordingly, it is an object of the present invention to provide a new and improved game.

Another object of the present invention is to provide a new and improved toss ball game device.

Another object of the present invention is to provide a compact, portable and relatively simple to play game.

Another object of the present invention is to provide a relatively inexpensive ball game device.

Another object of the present invention is to provide a relatively versatile ball game device capable of being played by one player, two players or opposing teams.

Another object of the present invention is to provide a ball game which can accommodate different skill/ability competitor players while presenting competitive challenges to each player.

Another object of the present invention is to provide a relatively safe and inexpensive yard game for children designed to avoid injuries.

BRIEF DESCRIPTION OF THE DRAWINGS

Other objects and advantages of the present invention may be more clearly seen when viewed in conjunction with the accompanying drawings. Similar reference numerals refer to similar parts throughout.

DESCRIPTION OF THE PREFERRED EMBODIMENTS

Figure 1:
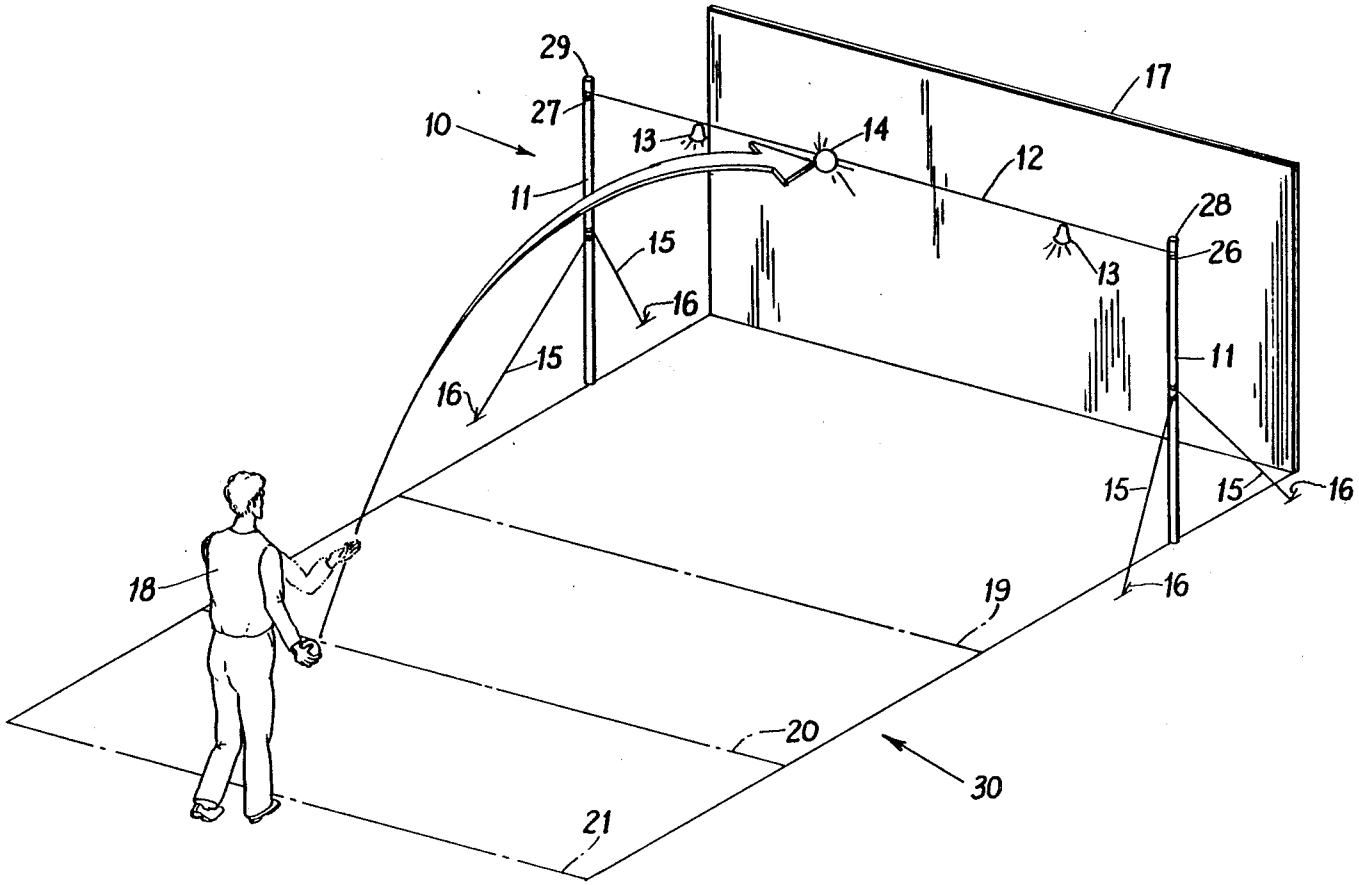
FIG. 1 is a perspective view of the toss ball game device being played by one player in accordance with the invention.
Figure 2:
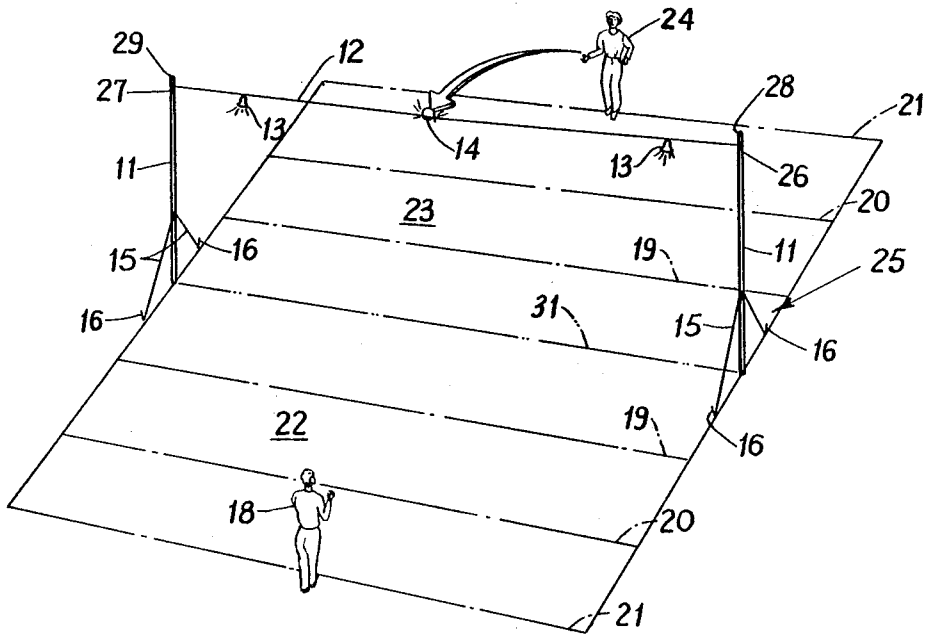
FIG. 2 is a perspective view of the toss ball game device being played by two players in accordance with the invention.

Referring to the drawings, particularly FIGS. 1 and 2, there is shown a toss ball game-device 10 constructed and being played in accordance with the present invention and to have a simple, robust structure easy to set up and easy to play by one or more persons.

Basically speaking, the toss ball game-device comprises a pair of spaced apart support poles 11, a line or cord 12, one or more bell or alarm devices 13 and at least one ball 14.

The support poles 11 are vertically supported in conventional manner such as by tension cables 15 which are secured, for example, by stakes 16, to the earth. Alternatively, a support base or stand (not shown) may be utilized which is weighted to provide the necessary pole supports and does not require cables and stakes.

The target line 12 is secured in a taut manner between the support poles 11 to provide an object target.

One or more bell or alarm devices 13 are connected to the target line 12, in conventional manner, such that with vibration or movement of the target line 12, the alarm devices 13 sound or score a point by the player.

The toss ball game is played by one person 18 by positioning the target line 12 substantially in parallel juxtaposition with a wall or backboard 17. The player 18 selects a difficulty foul-line 19, 20, or 21 to play from. Player 18 tosses ball 14 with the objective of hitting the target line 12. Each hit of the target line 12 scores a point. If the toss ball 14 misses or a skimming hit of the target line 12 occurs, the toss ball 14 rebounds off backboard 17 back to player 18.

In this manner, gentle exercise is provided player 18. The toss ball game is suitable for all ages while enabling the difficulty/skill level to be adjusted to accommodate different persons.

With particular reference to FIG. 2, the methods, objectives and rules of play with two or more players will now be described.

The target line 12 is supported/stretched between poles 11 in similar manner as described with reference to FIG. 1.

Poles 11 and target line 12 are arranged or set up on a court or playing field as shown in FIG. 2 to provide a playing field 22 and 23 on both sides of the target line 12.

Each playing field has a plurality of skill goal lines 19, 20, and 21.

Each player 18, 24 selects a goal line 19, 20, or 21 from which to compete/play from. The selected goal line may be changed by the players in order to accommodate for different skill, age and physical abilities. The playing field shown in FIG. 2 is generally designated by the reference numeral 25. The target line 12 is secured at opposite ends 26 and 27 to respective upper end portions 28 and 29. The playing field shown in FIG. 1 is generally designated by the reference numeral 30.

The rules of the game are generally simple to understand and follow.

First, a winning score is selected by the players such as the first one to attain a score of eleven or twenty-one.

Second, one of the players is selected to toss-ball first. The selection method may be of conventional method such as by flipping a coin.

Third, the first player 24, tosses the ball at the target line 12. If the target line 12 is hit by the ball 14, the first player 24 gets another turn or try at tossing the ball 14. This continues until the first player 24 either misses the target line 12 or attains a winning score. Each time a player hits the target line 12, he scores one point.

Fourth, the second player 18, following a miss by the first player 24, is given the opportunity to score points by tossing the ball 14 at the target line 12. Second player 18 continues to have possession of the ball until he either misses the target line 12 or attains a winning score.

Fifth, the first player to attain the previously selected winning score is the winner of the game.

In this manner, a portable, compact, relatively inexpensive, easy to learn and play game device is provided which effects relatively safer, easier and more economical court type game activity, which obviates the need for expensive rackets.

While there has been shown what is considered to be the preferred embodiments of the invention, it should be apparent to those skilled in the art that numerous modifications may be made thereto without departing from the spirit and scope of the invention.

I claim:

1. A yard game having particular utility for being safely played by one or more children and adults of different skill and physical abilities, in combination comprising:

a playing field (25) having a center court, a first foul-line position (19), a second foul-line position (20) and a third foul-line position (21);

a pair of spaced apart vertically mounted support poles (11) each being mounted generally at said center court (26);

a support means (16) connected to each support pole (11) for holding said support poles in a normal disposition with said playing field;

a target line (12) secured at opposite ends (26, 27) to a respective upper end portion (28, 29) of said pair of support poles, said target line being tightly drawn between said pair of support poles;

one or more alarm means (13) coupled to said target line for signaling a vibration displacement of said target line;

one or more toss balls;

whereby a first player tosses said toss ball at and aiming to hit said target line to score a point, the first player continues to toss said toss balls at said target line until the first player either attains a preselected winning score or misses the target line with a tossed toss ball, next, a second player is given a turn at tossing one or more toss balls from the other court side from the first player until the second player either attains the winning score or misses the target line, each player alternates turns at tossing as above until a winning score is attained by one of the players.

2. A yard game as in claim 1, wherein:

the first player is positioned for play at a selected one of said foul-line positions (19, 20, 21);

the second player is positioned for play at a selected one of said foul-line positions (19, 20, 21).

* * * * *